United States Patent [19]

Smith, Jr. et al.

[11] Patent Number: 4,750,954

[45] Date of Patent: Jun. 14, 1988

[54] HIGH TEMPERATURE NICKEL BASE ALLOY WITH IMPROVED STABILITY

[75] Inventors: Darrell F. Smith, Jr.; Edward F. Clatworthy; Thomas H. Bassford, all of Huntington, W. Va.

[73] Assignee: Inco Alloys International, Inc., Huntington, W. Va.

[21] Appl. No.: 907,055

[22] Filed: Sep. 12, 1986

[51] Int. Cl.[4] ..... C22C 19/05

[52] U.S. Cl. ..... 148/428

[58] Field of Search ..... 420/445, 446; 148/410, 148/428, 13

[56] References Cited

U.S. PATENT DOCUMENTS 3,859,060 1/1975 Eiselstein et al. ..... 420/445

*Primary Examiner*—R. Dean

*Attorney, Agent, or Firm*—Raymond J. Kenny; Francis J. Mulligan, Jr.

[57] ABSTRACT

A nickel-chromium-molybdenum base alloy characterised by exceptional structural stability when exposed at temperatures upwards of 1800° F. for prolonged periods of time, such as 10,000 hours.

13 Claims, 1 Drawing Sheet

EFFECT OF EXPOSURE TIME

ON IMPACT ENERGY

HIGH TEMPERATURE NICKEL BASE ALLOY WITH IMPROVED STABILITY

FIELD OF INVENTION

Figure 1:
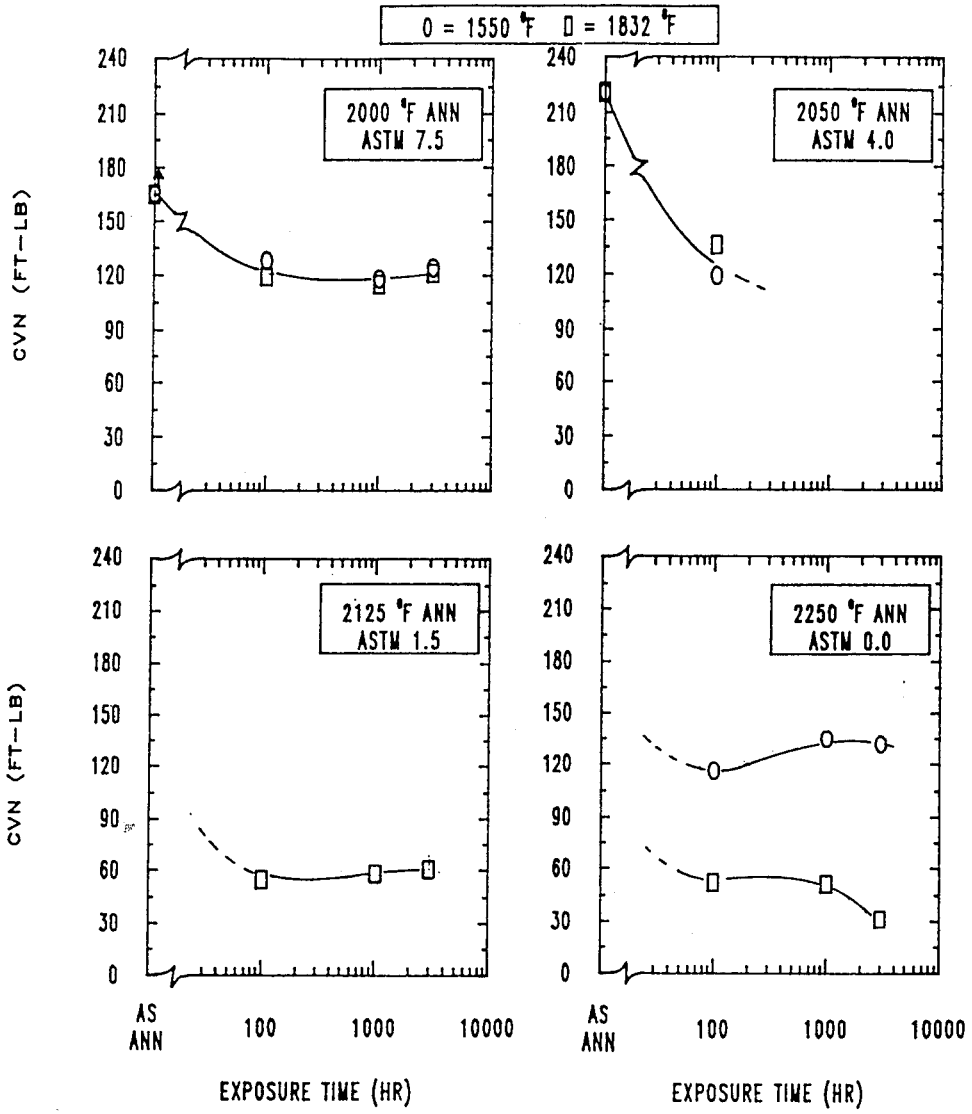

The subject invention is directed to a nickel-chromium-molybdenum (Ni-Cr-Mo) alloy, and particularly to a Ni-Cr-Mo alloy which manifests a combination of exceptional impact strength and ductility upon exposure to elevated temperature, e.g., 1000° C. (1832° F.), for prolonged periods of time, 3,000 hours and more, while concomitantly affording high tensile and stress-rupture strengths plus good resistance to cyclic oxidation at high temperature.

INVENTION BACKGROUND

Essentially, the present invention is an improvement over an established alloy disclosed in U.S. Pat. No. 3,859,060. This patent encompasses a commercial alloy known as alloy 617, a product which has been produced and marketed for a number of years. Nominally, the 617 alloy contains about 22% chromium, 9% molybdenum, 1.2% aluminum, 0.3% titanium, 2% iron, 12.5% cobalt, 0.07% carbon, as well as other constituents, including 0.5% silicon, one or more of boron, manganese, magnesium, etc., the balance being nickel. The virtues of alloy 617 include (i) good scaling resistance in oxidizing environments, including cyclic oxidation, at elevated temperature, (ii) excellent stress rupture strength, (iii) good tensile strength and ductility at both ambient and elevated temperatures, etc.

Alloy 617 also possesses structural stability under, retrospectively speaking, what might be characterized as, comparatively speaking, moderate service conditions. But as it has turned out it is this characteristic which has given rise to a problem encountered commercially for certain intended and desired applications, e.g., high temperature gas feeder reactors (HTGR). This is to say, when the alloy was exposed to more stringent operating parameters of temperature (1800° F.) and time (1000–3000+ hours) an undesirable degradation in structural stability occurred, though stress rupture, tensile and oxidation characteristics remained satisfactory.

Apparently, what happened was that prior to the 1800° F./1000+ hour operating conditions, the test temperature for stability study was usually not higher than 1600° F. And if higher temperatures were considered, short term exposure periods, circa 100 hours, were used. Longer term periods (circa 10,000 hours or more) were used but at the lower temperatures, i.e., not more than 1300° F.–1400° F.

Apart from temperature/time operating conditions, the problem would not surface because in many applications structural stability was not critically important, e.g., boats used for catalyst-grid supports, heat treating baskets, reduction boats used in refining certain metals, etc.

Accordingly, the problem became one of ascertaining the cause(s) for the stability deterioration at upwards of 1800° F.–2000° F. for periods well exceeding 1000 hours, and evolving, if possible, a new alloy which would result in enhanced stability under such operating conditions but without incurring a detrimental sacrifice in stress-rupture/oxidation/tensile properties.

THE INVENTION

We have found that silicon and molybdenum when present to the excess can adversely affect the stability of Alloy 617. We have also found that carbon, if beyond the range specified below herein, can, depending upon chemistry, exercise a negative influence. Moreover, it has been determined that grain size plays a significant, if not the major, role, grain size being influenced by composition and processing, particularly annealing treatment. Grain size, chemistry, particularly silicon, molybdenum and carbon, and annealing temperature are interrelated or interdependent as will become more clear infra. The invention herein involves the critical controlling of these related aspects.

EMBODIMENTS OF THE INVENTION

Generally speaking and in accordance with the present invention, the alloy contemplated herein contains about 7.5 to about 8.75% molybdenum, not more than 0.25% silicon, 0.05% to 0.15% carbon, the molybdenum/silicon/carbon being interrelated and controlled as indicated hereinafter, about 20% to 30% chromium, about 7.5% to 20% cobalt, up to about 0.6% titanium, about 0.8% to 1.5% aluminum, up to about 0.006% boron, up to 0.1% zirconium, up to about 0.075% magnesium, and the balance essentially nickel. The term "balance" or "balance essentially" as used herein does not exclude the presence of other constituents, such as deoxidizing and cleansing elements, in amounts which do not adversely affect the basic properties otherwise characteristic of the alloy. In this connection, any iron should not exceed 5%, and preferably does not exceed about 2%, to avoid subverting stress-rupture strength at temperatures such as 2000° F. Sulfur and phosphorous should be maintained at low levels, say, not more than 0.015% and 0.03%, respectively. In respect of other elements, the presence of tungsten can be tolerated and copper, and manganese if present, should not exceed 1%, respectively.

In carrying the invention into practice, and in endeavoring to achieve consistent results, care must be exercised in respect of compositional control. Silicon has been found to act subversively, particularly at high molybdenum and carbon contents. In retrospect, virgin materials were used in the research stage of Alloy 617. Thus, silicon was at a low level. But in commercial production scrap materials are used wherever possible to reduce cost. As a consequence, higher percentages of silicon would have been employed since the overall adverse effect of silicon in conjunction with molybdenum/carbon, grain size/annealing temperature at 1800°–2000° F. was neither known nor understood prior to the present invention. As indicated above, a typical commercial nominal silicon content is 0.5% and there are current commercial "specifications" where the silicon can be as high as 1% with molybdenum being as high as 11%.

Morphologically speaking, the subject alloy is of the solid-solution type and further strengthened/hardened by the presence of carbides, gamma prime hardening being minor to insignificant. The carbides are of both the $M_{23}C_6$ and $M_6C$ types. The latter is more detrimental to room temperature ductility when occurring as continuous boundary particles. The higher levels of silicon tend to favor $M_6C$ formation. This, among other reasons, dictates that silicon be as low as practical though some amount will usually be present, say, 0.01%, with the best of commercial processing techniques.

Molybdenum, while up to 9% may be tolerated, should not exceed about 8.75% in an effort to effect optimum stability, as measured by Charpy-V-Notch impact strength and tensile ductility (standard parameters). This is particularly apropos at the higher silicon levels. As will be shown infra, molybdenum contents even at the 10% level detract from CVN impact strength, particularly at silicon levels circa 0.2–0.25%. Molybdenum contributes to elevated temperature strength and thus at least about 8% should preferably be present. Tests indicate that stress-rupture life is not impaired at the 2000° F. level though a reduction (acceptable) may be experienced at 1600° F. in comparison with Alloy 617. Given the foregoing, it is advantageous that the silicon and molybdenum be correlated as follows:

| % Silicon | % Molybdenum |
|---|---|
| 0.01–0.1 | less than 9 |
| 0.1–0.15 | less than 8.75 |
| 0.15–0.25 | less than 8.5 |

With regard to carbon, a range of 0.05 to 0.1%, particularly 0.05 to 0.07%, is advantageous. Carbon contributes to stress-rupture strength but detracts from structural stability at high percentages. Low levels say, 0.03–0.04%, particularly at low molybdenum contents, result in an unnecessary loss of stress-rupture properties. Carbon also influences grain size by limiting the migration of grain boundaries. As carbon content increases, higher solution temperatures are required to achieve a given recrystallized grain diameter.

Where optimum corrosion resistance is required, chromium can be used up to 30%. But at such levels chromium together with molybdenum in particular may lead to forming an undesired volume of the embrittling sigma phase. It need not exceed 28% and in striving for structural stability a range of 19 to 23% is beneficial.

In addition to the foregoing, it has been determined that grain size has a marked influence on toughness. Chemistry and processing control, mainly annealing temperature, are interdependent in respect of grain size. While it has been customary to final anneal Alloy 617 at 2175° to 2200° F. commercially, in accordance with the present invention annealing should be conducted below about 2150° F. and above 2000° F. The effect of annealing temperature on a commercial size, 22,000 lbs., melt is given in Tables IV and V. An annealing temperature of, say 2200° F., promotes the formation of the coarser grains but stress-rupture properties are higher. On the other hand, very low annealing temperatures, say 1900°–1975° F., offer a finer grain size but stress-rupture is unnecessarily adversely impacted. Accordingly, it is preferred that the annealing temperature be from 2025° to less than 2150° F. with a range of 2025° to about 2125° F. being preferred. While the grain size may be as coarse as ASTM 0 or 00 where the highest stress-rupture properties are necessary, it is preferred that the average size of the grains be finer than about ASTM 1 and coarser than about ASTM 5.5, e.g., ASTM 1.5 to ASTM 4.

To give those skilled in the art a better appreciation of the invention, the following information and data are given:

14 kg vacuum induction laboratory heats were made, then forged at about 2200° F. to 13/16 inch squares for hot rolling (2200° F.) to 9/16 inch rounds. Respresentative compositions are given in TABLE I. Alloys AA through DD are outside the invention.

TABLE I

| Alloy No. | C | Mn | Fe | Si | Ni | Cr | Al | Ti | Co | Mo | B | Zr |
|---|---|---|---|---|---|---|---|---|---|---|---|---|
| 1 | 0.07 | 0.011 | 1.33 | 0.06 | 56.23 | 21.98 | 1.08 | 0.61 | 10.99 | 7.60 | 0.004 | 0.014 |
| 2 | 0.11 | 0.005 | 0.74 | 0.04 | 54.90 | 22.54 | 1.17 | 0.48 | 11.89 | 8.19 | 0.003 | 0.014 |
| 3 | 0.08 | 0.008 | 0.69 | 0.21 | 54.34 | 22.63 | 1.17 | 0.41 | 12.00 | 8.47 | 0.002 | 0.014 |
| 4 | 0.13 | 0.008 | 0.67 | 0.22 | 54.43 | 22.73 | 1.22 | 0.41 | 12.01 | 8.28 | 0.001 | 0.014 |
| AA | 0.07 | 0.007 | 0.68 | 0.23 | 52.81 | 22.59 | 1.21 | 0.42 | 12.00 | 10.11 | 0.003 | 0.014 |
| BB | 0.11 | 0.008 | 0.67 | 0.23 | 52.51 | 22.71 | 1.21 | 0.41 | 12.00 | 10.33 | 0.002 | 0.014 |
| CC | 0.06 | 0.008 | 0.71 | 0.04 | 53.04 | 22.46 | 1.17 | 0.44 | 11.99 | 10.17 | 0.003 | 0.014 |
| DD | 0.12 | 0.009 | 0.69 | 0.04 | 52.58 | 22.76 | 1.19 | 0.43 | 11.97 | 10.29 | 0.002 | 0.014 |

Annealing temperatures were 2125° F. and 2250° F., respectfully, the specimens being held thereat for 1 hour, then air cooled. The alloys were exposed at 1832° F. (100° C.) for 100, 1000, 3000 and 10,000 hours and air cooled as set forth in TABLE II which sets forth the data obtained i.e., grain size, Rockwell hardness (Rb), yield (YS) and tensile strengths (TS), elongation (El.), Reduction of (RA) and Charpy V-Notch Impact Strength (CVN), the latter serving to assess structural stability.

TABLE II

| Alloy | Chemistry | | | Anneal | Exposure | ASTM | Hard | 0.2% YS | TS | El | RA | Impact Strength CVN |
|---|---|---|---|---|---|---|---|---|---|---|---|---|
| No. | C | Si | Mo | °F./hr | °F./hr. | GS # | Rb | ksi | ksi | % | % | Ft-lb |
| 1 | .07 | .06 | 7.60 | 2125/1,A | | $4\frac{1}{2}^{m}$ | — | 52.8 | 124.5 | 50. | 57.5 | >240. |
| | | | | 2125/1,A | 1832/100,A | 5 | 91. | 47.9 | 125.0 | 48. | 56.0 | 119. |
| | | | | 2125/1,A | 1832/1,000,A | — | 92.5 | 47.3 | 123.0 | 48.5 | 54. | 53.5 |
| | | | | 2125/1,A | 1832/3,000,A | $5^{m}$ | 90.5 | 48.2 | 120.3 | 50. | 53.5 | 57.5 |
| | | | | 2125/1,A | 1832/10,000,A | 4 | 86. | 42.8 | 114.0 | 48. | 42.5 | 103. |
| | | | | 2250/1,A | | 0 | | 40.1 | 103.0 | 66. | 53.0 | >240. |
| | | | | 2250/1,A | 1832/100,A | $\frac{1}{2}$ | 88. | 42.6 | 116.5 | 48. | 44.5 | 109. |
| | | | | 2250/1,A | 1832/1,000,A | — | 90. | 42.7 | 103.5 | 22. | 21.* | 69. |
| | | | | 2250/1,A | 1832/3,000,A | 00 | 86.5 | 43. | 93.1 | 21.5 | 20. | 57. |
| | | | | 2250/1,A | 1832/10,000,A | 00 | — | — | — | — | — | 33.5 |
| 2 | .11 | .04 | 8.19 | 2125/1,A | | 9** | — | 62.2 | 135.5 | 43. | 50.5 | 92. |
| | | | | 2125/1,A | 1832/100,A | 6 | 92. | 48.8 | 128.0 | 44. | 52.0 | 109. |

TABLE II-continued

| Alloy No. | Chemistry C | Si | Mo | Anneal °F./hr | Exposure °F./hr. | ASTM GS # | Hard Rb | 0.2% YS ksi | TS ksi | El % | RA % | Impact Strength CVN Ft-lb |
|---|---|---|---|---|---|---|---|---|---|---|---|---|
| | | | | 2125/1,A | 1832/1,000,A | — | 96.5 | 57.7 | 131.0 | 43. | 50. | 77.5 |
| | | | | 2125/1,A | 1832/3,000,A | 5[m] | 92.5 | 46.6 | 123. | 48.5 | 57.5 | 68.5 |
| | | | | 2125/1,A | 1832/10,000,A | 4 | 87. | 93.6 | LR | 48. | 48. | 91. |
| | | | | 2250/1,A | | 2½ | — | 44.3 | 111.0 | 59. | 47.0 | 156. |
| | | | | 2250/1,A | 1832/100,A | 2 | 91. | 46.3 | 123.0 | 44. | 42.0 | 84. |
| | | | | 2250/1,A | 1832/1,000,A | — | 93. | 44.0 | 121.5 | 38.5 | 31.5 | 52.5 |
| | | | | 2250/1,A | 1832/3,000,A | 2 | 89. | 44.1 | 111.5 | 27. | 25.5 | 40.5 |
| | | | | 2250/1,A | 1832/10,000,A | 0 | 86. | 44.8 | 95.2 | 19. | 16. | 34.5 |
| 3 | .08 | .21 | 8.47 | 2125/1,A | | 5[m] | — | 51.6 | 124.5 | 51. | 57. | 123.0 |
| | | | | 2125/1,A | 1832/100,A | 5 | 90.0 | 47.9 | 122.5 | 50. | 56.0 | 117.0 |
| | | | | 2125/1,A | 1832/1,000,A | — | 93. | 49.1 | 127.0 | 48.5 | 58. | 66.0 |
| | | | | 2125/1,A | 1832/3,000,A | 6[m] | 93. | 49.1 | 123.5 | 50. | 54. | 61. |
| | | | | 2125/1,A | 1832/10,000,A | 4[m] | 86.5 | 44.9 | 114.5 | 50. | 46.5 | 90. |
| | | | | 2250/1,A | | 0 | — | 41.3 | 102.0 | 66. | 55.0 | 130.0 |
| | | | | 2250/1,A | 1832/100,A | 0 | 84.0 | 42.6 | 111.5 | 47. | 40. | 87.0 |
| | | | | 2250/1,A | 1832/1,000,A | — | 90. | 42.6 | 111.0 | 34. | 29. | 74.5 |
| | | | | 2250/1,A | 1832/3,000,A | ½ | 86. | 43.1 | 103.5 | 30. | 24.5 | 56.5 |
| | | | | 2250/1,A | 1832/10,000,A | 0 | 83. | 41.5 | 100.5 | 27. | 22.5 | 32. |
| 4 | .13 | .22 | 8.28 | 2125/1,A | | 5½ | — | 51.6 | 127.5 | 46. | 49.0 | 79.0 |
| | | | | 2125/1,A | 1832/100,A | 6 | 92.5 | 49.4 | 127.5 | 43. | 53.5 | 87.0 |
| | | | | 2125/1,A | 1832/1,000,A | — | 93.5 | 50.5 | 131.0 | 44. | 53.5 | 69.5 |
| | | | | 2125/1,A | 1832/3,000,A | 6½ | 94. | 51.9 | 130. | 44. | 54. | 64. |
| | | | | 2125/1,A | 1832/10,000,A | 6[m] | 90 | 48.8 | 124.5 | 45.5 | 52 | 74 |
| | | | | 2250/1,A | | 3½ | — | 47.3 | 116.0 | 55. | 47.0 | 119.0 |
| | | | | 2250/1,A | 1832/100,A | 3½ | 91.0 | 46.1 | 122.5 | 46. | 48.0 | 72.0 |
| | | | | 2250/1,A | 1832/1,000,A | — | 92. | 45.6 | 122.0 | 35.5 | 31. | 50.0 |
| | | | | 2250/1,A | 1832/3,000,A | 2 | 90.5 | 46.4 | 108. | 22. | 21. | 41. |
| | | | | 2250/1,A | 1832/10,000,A | 1 | 88 | 44.5 | 104. | 23. | 21. | 38.5 |
| AA | .07 | .23 | 10.11 | 2125/1,A | | 5½ | — | 51.8 | 123.0 | 53. | 55.5 | 121.0 |
| | | | | 2125/1,A | 1832/100,A | 5½ | 91.0 | 48.0 | 121.5 | 44. | 38.5 | 65.0 |
| | | | | 2125/1,A | 1832/1,000,A | — | 93.0 | 46.4 | 123.5 | 48.5 | 51.5 | 62.5 |
| | | | | 2125/1,A | 1832/3,000,A | 5 | 91.5 | 47.1 | 120. | 48.5 | 54. | 56. |
| | | | | 2125/1,A | 1832/10,000,A | 5 | 88. | 46.2 | 115.5 | 50.5 | 55. | 76. |
| | | | | 2250/1,A | | 1 | — | 43.5 | 103.5 | 67. | 51.5 | 132.0 |
| | | | | 2250/1,A | 1832/100,A | 0 | 87.5 | 43.8 | 98.5 | 24. | 20.5 | 28.5 |
| | | | | 2250/1,A | 1832/1,000,A | — | 88.5 | 43.6 | 72.6 | 8.5 | 8. | 16.5 |
| | | | | 2250/1,A | 1832/3,000,A | 1 | 86.5 | 41.6 | 80.9 | 14. | 14.5 | 9. |
| | | | | 2250/1,A | 1832/10,000,A | 0 | 84.5 | 40.2 | 63.0 | 6.5 | 5.5 | 8. |
| BB | .11 | .23 | 10.33 | 2125/1,A | | 7½ | — | 55.9 | 129.5 | 46. | 43.0 | 63.0 |
| | | | | 2125/1,A | 1832/100,A | 6½ | 93.5 | 53.0 | 127.5 | 43. | 48.5 | 64.0 |
| | | | | 2125/1,A | 1832/1,000,A | — | 95.5 | 49.8 | 126.0 | 44. | 48. | 67.5 |
| | | | | 2125/1,A | 1832/3,000,A | 5 | 95.5 | 50.9 | 128. | 43. | 47. | 53. |
| | | | | 2125/1,A | 1832/10,000,A | 6[m] | 91.5 | 48.8 | 121.5 | 45. | 45. | 50.5 |
| | | | | 2250/1,A | | 3½ | — | 48.6 | 114.5 | 55. | 45.5 | 94.0 |
| | | | | 2250/1,A | 1832/100,A | 3 | 92.0 | 48.1 | 115.5 | 27. | 21.5 | 26.0 |
| | | | | 2250/1,A | 1832/1,000,A | — | 93. | 48.0 | 111.5 | 18.5 | 15* | 22.5 |
| | | | | 2250/1,A | 1832/3,000,A | ½ | 91.5 | 46.6 | 89.7 | 10.5 | 11 | 22. |
| | | | | 2250/1,A | 1832/10,000,A | 1 | 90.0 | 44.6 | 107.5 | 23. | 19.5 | 19. |
| CC | .06 | .04 | 10.17 | 2125/1,A | | 4½ | — | 50.7 | 120.0 | 56. | 61.0 | >240. |
| | | | | 2125/1,A | 1832/100,A | 4 | 87.5 | 43.8 | 114.0 | 46. | 38.5 | 82.5 |
| | | | | 2125/1,A | 1832/1,000,A | — | 91.5 | 47.1 | 119.5 | 50. | 47.5 | 80. |
| | | | | 2125/1,A | 1832/3,000,A | 4 | 90.5 | 47. | 118. | 51.5 | 49. | 41. |
| | | | | 2125/1,A | 1832/10,000,A | 4[m] | 86. | 44.1 | 113. | 51.5 | 48. | 74.5 |
| | | | | 2250/1,A | | 1 | 80.0 | 43.5 | 103.5 | 69. | 60.0 | >240. |
| | | | | 2250/1,A | 1832/100,A | 0 | 85.0 | 41.8 | 106.0 | 41. | 32.0 | — |
| | | | | 2250/1,A | 1832/100,A | — | 85.5 | 41.5 | 105.0 | 41. | 31.5 | 53.0 |
| | | | | 2250/1,A | 1832/1,000,A | — | 87.5 | 43.0 | 111.5 | 41.5 | 34. | 42.5 |
| | | | | 2250/1,A | 1832/3,000,A | 0 | 86.5 | 42.8 | 103.5 | 30. | 27. | 42. |
| | | | | 2250/1,A | 1832/10,000,A | ½ | 84. | 42.6 | 97.0 | 28. | 24. | 35. |
| DD | .12 | .04 | 10.29 | 2125/1,A | | 5 | — | 54.0 | 132.0 | 46. | 40.5 | 79.0 |
| | | | | 2125/1,A | 1832/100,A | 5½ | 93.0 | 51.3 | 129.5 | 44. | 49.5 | 80.0 |
| | | | | 2125/1,A | 1832/1,000,A | — | 94.0 | 50.9 | 127.0 | 45.5 | 53.0 | 65.5 |
| | | | | 2125/1,A | 1832/3,000,A | 4 | 95. | 52.8 | 128.5 | 43. | 40. | 67. |
| | | | | 2125/1,A | 1832/10,000,A | 5 | 91. | 48.4 | 120.5 | 47 | 47.5 | 66. |
| | | | | 2250/1,A | | 3½ | — | 49.1 | 118.0 | 55. | 45.5 | 110.0 |
| | | | | 2250/1,A | 1832/100,A | 3 | 92.0 | 48.4 | 124.0 | 41. | 32.5 | 46.5 |
| | | | | 2250/1,A | 1832/1,000,A | — | 93. | 48.6 | 105.5 | 16.5 | 15.* | 36.0 |
| | | | | 2250/1,A | 1832/3,000,A | 1 | 92. | 47.7 | 101.5 | 17. | 14. | 30. |
| | | | | 2250/1,A | 1832/10,000,A | 1½ | 88.5 | 45.5 | 89.5 | 14. | 13. | 29. |

A = Air Cooled
[m]Mixed Grain
LR = Lost Reading
*Broke Outside Punch Marks
**grain size believed in error for unknown reasons Concerning the data above given, Alloys AA and BB resulted in markedly lower impact levels than Alloys 1–4, especially low silicon, low molybdenum Alloys 1 and 2, particularly when annealed at 2250° F. Alloys AA and BB had, comparatively speaking, high percentages of both silicon and molybdenum together with a coarse grain varying from ASTM 0 to 1. Alloys CC and DD while better than AA and BB due, it is deemed to much lower silicon percentages, were still much inferior to Alloys 1–4 given a 2125° F. anneal. While the Charpy-V-Notch impact data for Alloys AA-DD appear to be good for the 2125° F. anneal, our investigations have indicated that with commercial size heats impact strengths for alloys of high molybdenum significantly drop off. Also, there is danger/risk of not controlling annealing temperature and the 2250° F. anneal reflects what can be expected in terms of anticipated structural stability.

In TABLE III are reported stress rupture data for the Alloys In Table I. In this case the annealing temperature was 2150° F. While the stress (5KSI) used at 1832° F. is fairly high for that temperature level, stress rupture properties for the alloys within the invention are satisfactory.

TABLE III

| Alloy No. | C | Si | Mo | ASTM GS # | Temp °F. | Stress ksi | Life hrs. | EL % | RA % |
|---|---|---|---|---|---|---|---|---|---|
| 1 | .07 | .06 | 7.60 | 7.5 | 1200 | 60 | 1317.5 | 24.5 | 26.5 |
| | | | | | 1400 | 30 | 651.5 | 53. | 71. |
| | | | | | 1600 | 14 | 40.7 | 68.5 | 89.5 |
| | | | | | 1832 | 5 | 29.4 | 51. | 62. |
| 2 | .11 | .04 | 8.19 | 5. | 1200 | 60 | 453.7 | 10.5 | 14. |
| | | | | | 1400 | 30 | 473.4 | 47. | 45. |
| | | | | | 1600 | 14 | 22.1 | 61.5 | 77. |
| | | | | | 1832 | 5 | 24. | 45.5 | 52. |
| 3 | .08 | .21 | 8.47 | 5. | 1200 | 60 | 203.6 | 16. | 14.5 |
| | | | | | 1400 | 30 | 374.6 | 17. | 44. |
| | | | | | 1600 | 14 | 17.8 | 63.5 | 83. |
| | | | | | 1832 | 5 | 114.1 | 38. | 39. |
| 4 | .13 | .22 | 8.28 | 6.5 | 1200 | 60 | 430.7 | 13.5 | 15. |
| | | | | | 1400 | 30 | 424.1 | 35.5 | 65.5 |
| | | | | | 1600 | 14 | 26.0 | 91.5 | 69. |
| | | | | | 1832 | 5 | 56.2 | 35.5 | 40. |
| AA | .07 | .23 | 10.11 | 6. | 1200 | 60 | 1468.3 | 22.5 | 24. |
| | | | | | 1400 | 30 | 808.3 | 44. | 76.5(1) |
| | | | | | 1600 | 14 | 30.9 | 92. | 90. |
| | | | | | 1832 | 5 | 62.2 | 57. | 66. |
| BB | .11 | .23 | 10.33 | 8. | 1200 | 60 | 1729. | 33.5 | 35.5 |
| | | | | | 1400 | 30 | 520.7 | 49. | 72. |
| | | | | | 1600 | 14 | 30.7 | 120.5 | 87.5 |
| | | | | | 1832 | 5 | 39.9 | 46.6 | 66.5 |
| CC | .06 | .04 | 10.17 | 7. | 1200 | 60 | 655.8 | 18.5 | 20.5 |
| | | | | | 1400 | 30 | 643.3 | 40. | 64. |
| | | | | | 1600 | 14 | 42.2 | 79. | 87.5 |
| | | | | | 1832 | 5 | 169.6 | 39. | 33.5 |
| DD | .12 | .04 | 10.29 | 6.5 | 1200 | 60 | 2592.5 | 23. | 28. |
| | | | | | 1400 | 30 | 567.8 | 44.5 | 59. |
| | | | | | 1600 | 14 | 124.3 | 65.5 | 82. |
| | | | | | 1832 | 5 | 65.3 | 31.5 | 42. |

(1)Pulled out of grips @ 32.9 hours. restarted.

Tables IV and V pertain to a 22,000 lb. commercial size heat which was produced using vacuum induction melting followed by electroslag refining. The material was processed into ¾" dia. hot rolled rounds for testing and evaluation. The as-hot-finished rod stock was used for an annealing evaluation/grain size study evaluation. The composition of the heat Alloy 5, is given below in Table IV with annealing temperature and grain size reported in Table V.

TABLE IV

| Element, | Wt. % | Element, | Wt. % |
|---|---|---|---|
| chromium | 21.88 | iron | 0.21 |

TABLE IV-continued

| Element, | Wt. % | Element, | Wt. % |
|---|---|---|---|
| cobalt | 12.48 | manganese | 0.01 |
| molybdenum | 8.62 | boron | 0.002 |
| carbon | 0.05 | magnesium | 0.001 |
| silicon | 0.07 | sulphur | 0.001 |
| aluminum | 1.26 | phosphorous | 0.002 |
| titanium | 0.23 | copper | 0.01 |
| | | nickel | 55.18 |

TABLE V

| Anneal 1 hour at Temperature Followed By Water Quench | Grain Size, ASTM Grain No. |
|---|---|
| 2000 | 7.5 |
| 2050 | 4.0 |
| 2100 | 1.5 |
| 2125 | 1.5 |
| 2150 | 1.0 |
| 2175 | 1.0 |
| 2200 | 0 |
| 2225 | 0 |
| 2250 | 0 |

As reflected by Table V, given the chemistry in IV, an annealing temperature above 2175°, e.g. 2200° F., and above resulted in an excessively coarse grain structure whereas annealing at 2000° F. gave too fine a grain. As indicated above herein, a final annealing should be conducted above 2000° F. to about 2150° F.

The effect of annealing temperatures (2000° F., 2050° F., 2125° F., 2250° F.) and grain size on structural stability as indicated by the Charpy-V-Notch test size is shown in Table VI, and is more graphically depicted in FIG. 1. Table VI includes tensile properties, stress rupture results being given in Table VII.

TABLE VI

| Anneal Temp., (°F.) | Exposure Temp., °F. | Exposure Time, Hrs. | G.S. ASTM No. | HD, (Rb) | 0.2% YS, (ksi) | TS, (ksi) | El, (%) | RA, (%) | CVN, (Ft lbs) |
|---|---|---|---|---|---|---|---|---|---|
| As Hot Rolled | | | 8 | 94 | 67 | 128 | 49 | 55.5 | |
| 2000 | — | — | 7.5 | 94.5 | 56.2 | 123.5 | 50 | 63. | >165 |
| | 1550 | 100 | | 94 | 63.4 | 127.5 | 47 | 59 | 128 |
| | | 1,000 | 7.5 | 93.5 | 62.7 | 126.5 | 47 | 60.5 | 118 |
| | | 3,000 | | 94.5 | 60.6 | 126.5 | 46 | 56.5 | 124 |
| | | 10,000 | | 93.5 | 61.3 | 126.5 | 47 | 60* | 114* |
| | 1832 | 100 | | 94 | 60.6 | 127 | 48.5 | 61.5 | 119 |
| | | 1,000 | 7.5 | 93 | 59.4 | 125.5 | 48 | 62 | 115 |
| | | 3,000 | | 86 | 52.6 | 121 | 47.5 | 60 | 121 |
| | | 10,000 | | 82.5 | 40.3 | 110.1 | 56 | 65 | |
| 2050 | — | — | 4 | 95.5 | 53.3 | 121.5 | 50.5 | 65.5 | 221 |
| | 1550 | 100 | | 92 | 54.1 | 120 | 48 | 56 | 119 |
| | | 1,000 | | 92 | 54.2 | 121.7 | 49 | 61 | 130 |
| | | 3,000 | | | 54.3 | 121.9 | 51 | 63 | 138 |
| | | 10,000 | | 90.5 | 52.7 | 120 | 51 | 61 | 131 |
| | 1832 | 100 | | 92 | 51.8 | 120.5 | 51 | 63 | 136 |
| | | 1,009 | | 92 | 52.5 | 120.6 | 51 | 62 | 122 |
| | | 3,000 | | | 51 | 120.3 | 52 | 62 | 114**, 106 |
| | | 10,000 | | | | | | | 130 |
| 2125 | — | — | 1.5 | 83 | 39.8 | 101.5 | 71 | 75 | |
| | 1550 | 100 | | | | | | | |
| | | 1,000 | | 87 | 44.6 | 114 | 50.5 | 51 | 97 |
| | | 10,000 | | | | | | | |
| | 1832 | 100 | | 82 | 40.1 | 104.5 | 46 | 37 | 55 |
| | | 1,000 | | 82 | 37.5 | 96.1 | 42 | 36.5 | 58 |
| | | 3,000 | | 83 | 37.7 | 101.5 | 43.5 | 34.5 | 60 |
| | | 10,000 | | 82 | 38.3 | 100.4 | 45 | 36 | 58 |
| 2250 | — | — | 0 | 81.5 | 37.8 | 95.9 | 76 | 75 | >220 |
| | 1550 | 100 | | 88 | 44.7 | 109 | 47 | 39 | 116 |
| | | 1,000 | | 87 | 44 | 113 | 48 | 46.5 | 135 |
| | | 3,000 | | 88 | 42.7 | 111.5 | 30 | 49 | 132 |
| | | 10,000 | | 84.5 | 41.2 | 109.6 | 48 | 46* | 135* |
| | 1832 | 100 | | 82 | 38.3 | 98.2 | 42 | 32.5 | 52 |
| | | 1,000 | | 82 | 36.4 | 97.1 | 45 | 34.5 | 51 |
| | | 3,000 | | 81 | 36.1 | 85.7 | 32.5 | 28 | 31 |
| | | 10,000 | | 79 | 35.6 | 84.0 | 30 | 26 | 32 |

HD = s hardness
Rb = Rockwell hardness, B scale
GS = grain size
*went to 1710° F./5 min. at 3200 h
**went to 1990° F. for 1 hr. at 1700 h

TABLE VII

| | Stress Rupture Properties | | | | | |
|---|---|---|---|---|---|---|
| Ann. Temp °F./1 h, WQ | ASTM G.S. No. | Test Temp. (°F.) | Test Stress (ksi) | Life (h) | El (%) | RA (%) |
| 2000 | 7.5 | 1600 | 13 | 23.9 | 96.8 | 89.1 |
| 2050 | 4.0 | | | 39.9 | 83 | 91.5 |
| 2125 | 1.5 | | | 50.3 | 87 | 77.5 |
| 2250 | 0 | | | 47.2 | 85.5 | 69 |
| 0 | 7.5 | 2000 | 3.0 | 14.2 | 137.5 | 80 |
| 2050 | 4.0 | | | 18.1 | 115.5 | 76 |
| 2125 | 1.5 | | | 76.6 | 98 | 56.5 |
| 2250 | 0 | | | 96.0 | 46 | 56.5 |

The impact energy data at 1832° F. in Table VI confirms the superior results of a commercial size heat of an alloy composition/annealing temperature within the invention. For an exposure period of 10,000 hours and an annealing temperature of 2250° F., Alloy 5 manifested a borderline impact strength of 32 ft. lbs., versus, for example, 58 ft. lbs., when annealed at 2125° F. It is deemed that the impact energy level at 1832° F. and 10,000 hours exposure should be at least 40 ft. lbs. and preferably 50 ft. lbs. although, as suggested above 30 ft. lbs. is marginally acceptable. The 2000° F. anneal afforded high impact strength at 10,000 hours but as shown in Table VII stress-rupture life suffured, being 23.9 hours vs. 50 hours when annealed at 2125° F. The difference is even more striking at the 2000° F. test condition.

Apart from the foregoing and based on welding data at hand, the instant alloy is deemed readily weldable using conventional welding practices as will be demonstrated below. As a matter of general observation from the tests conducted, no base metal microfissuring was observed in the heat affected zone (HAZ) of a Gas Metal Arc (GMA) weldment. This test resulted in a slight loss of strength in the as-welded and annealed condition as would be expected but, more importantly, the deposit exhibited greatly improved ductility and impact strength after exposure to aging temperature, given corresponding properties for commercial Alloy 617. Gas shielded metal arc (GSMA) deposits made using filler metals of the invention alloy as a core wire in a coated welded electrode manifested improved ductility and impact strength in comparison with weld deposits using filler metal of commercial Alloy 617. In this connection, a significant loss of ductility was experienced after exposure and this was attributed to the elements, notably carbon and silicon, introduced in the deposit by the flux coating. It is deemed that such constituents are sufficient to induce high temperature reaction which are believed responsible for the ductility loss in the deposit.

With regard to the welding tests, plate 0.345 inch thick taken from hot band of Alloy 5 was annealed at both 1800° F. and 2200° F. to provide material of different grain sizes. (The 1800° F. would not cause a change in grain size, the original grain size being ASTM 2.5).

The 2200° F. anneal (which is not a recommended annealing treatment) gave a grain size beyond about ASTM 00. This was done with the purpose that an alloy of limited weldability, given the variation in grain size, would be expected to manifest some variation in base metal microfissuring. A weldment was deposited between two specimens of the plate (one of each anneal) by GMAW—spray transfer with 0.045 inch diameter filler metal from Alloy 5, the following parameters being used.

| | |
|---|---|
| Diameter - 0.045" | Joint Design - V-Butt - 60° Opening |
| Current - 220 amps | Voltage - 32 volts |
| Wirefeed - 423 ipm | Position - Flat - 1G |
| Flow Rate - 50 cfh | Travel Speed - 12–15 ipm (Manual) |

Transverse face, root and side bend specimens, centered in both the weld and heat affected zones (HAZ) were tested, (i.e., usually 3 specimens were taken from the weld plate per test conditions. Liquid penetration inspection revealed no fissuring in the welds or the HAZ. Using specimens bent over a thickness twice that of the specimens (2T), only one face bend test showed any fissuring; however, the fissures did not intersect the fusion line and were thus deemed not weld related but were probably due to plate surface. No other fissuring was detected in either liquid penetration or metallographic examination.

Filler metals of Alloy 5 were made in wire diameters of 0.045 and 0.093 inch and then used in Gas Metal Arc Welding (GMAW) spray transfer and Gas Tungsten Arc Welding (GTAW), respectively. A third wire, 0.125 inch in diameter was used as a core wire for producing a covered electrode for Shielded Metal Arc Welding (SMAW). Room temperature impact data from weldments of each of the GMAW, GTAW and SMAW are reported in Table VIII with mechanical properties being given in Table IX. The parameters for the GTAW and SMAW were as follows:

GTAW

Diameter—3/32"
Electrode Type/Diameter—2% Thoriated Tungsten/3/32"
Current—180 amperes DCEN
Voltage—12–14 volts
Shielding Gas—Argon
Flow Rate—25 cfh
Joint Design—V-Butt 60° Opening
Position—Flat—1G
Travel Speed—4–6 ipm (Manual)

SMAW

Diameter—⅛"
Current—90 amperes
Voltage—23 volts
Joint Design—V-Butt—60° Opening
Position—Flat—1G
Travel Speed—10–12 ipm (Manual)

TABLE VIII

Room Temperature Impact Data

| | Condition A* Impact | | | Condition B* Impact | | | Condition C* Impact | | | Condition D* Impact | | |
|---|---|---|---|---|---|---|---|---|---|---|---|---|
| Process | CVN (ft. lb.) | Lat. Exp. (mils) | Duct. Fract. (%) | CVN (ft. lb.) | Lat. Exp. (mils) | Duct. Fract. % | CVN (ft. lb.) | Lat. Exp. (mils.) | Duct. Fract. % | CVN (ft. lb.) | Lat. Exp. (mils) | Duct. Fract. % |
| GMAW | 214 | 81 | 100 | 222 | no fracture | | 135 | 80 | 100 | 88 | 63 | 100 |
| | | n.t. | | | n.t. | | 139 | 80 | 100 | 82 | 58 | 100 |
| | | n.t. | | | n.t. | | 132 | 80 | | 88 | 62 | 100 |
| GTAW | 179.5 | 97 | 100 | 239 | no fracture | | 113 | 78 | 100 | 68 | 60 | 100 |
| | 158 | 104 | 100 | | n.t. | | 118 | 76 | 100 | 62 | 58 | 100 |
| | 167 | 98 | 100 | | n.t. | | 114 | 81 | 100 | 63 | 59 | 100 |
| SMAW | 54 | 50 | 100 | 91.5 | 79 | 100 | 31 | 26 | 100 | 21 | 21 | 100 |
| SMAW | 46 | 45 | 100 | 113.0 | 76 | 100 | 30 | 29 | 100 | 18 | 19 | 100 |
| SMAW | 52 | 46 | 100 | 85.5 | 71 | 100 | 28 | 28 | 100 | 21 | 19 | 100 |

*A = As Welded
*B = Welded + Annealed 2200° F./1 h, WQ
*C = Welded + Annealed 2200° F./1 h, WQ + Exposed 1550° F./1000 h, AC
*D = Welded + Annealed 2200° F./1 h, WQ + Exposed 1832° F./1000 h, AC
Lat. Exp. = Lateral Expansion
Duct. Fract. = Ductile Fracture
n.t. = not tested

TABLE IX

Room Temperature Tensile Data

| Condition* | Process | UTS (ksi) | 0.2% YS (ksi) | Elong. (%) | Red. of Area (%) | Hardness (RB) |
|---|---|---|---|---|---|---|
| A | GMAW | 102.2 | 65.5 | 50 | 63.1 | 94/95 |
| A | GMAW | 104.1 | 63.4 | 50 | 57.0 | 90/91 |
| A | GMAW | 105.4 | 64.9 | 47 | 55.6 | 92 |
| B | GMAW | 104.0 | 46.4 | 65 | 70.9 | 82/83 |
| C | GMAW | 119.9 | 51.1 | 41 | 42.5 | 89/92 |
| D | GMAW | 109.1 | 43.5 | 49 | 40.2 | 83/86 |
| A | GTAW | 109.2 | 71.4 | 44 | 60.0 | 94/96 |
| B | GTAW | 106.8 | 45.6 | 61 | 71.1 | 84 |
| C | GTAW | 120.4 | 50.6 | 46 | 51.9 | 89/91 |
| D | GTAW | 111.8 | 42.8 | 51 | 45.1 | 85/87 |
| A | SMAW | 113.3 | 69.0 | 41 | 37.9 | 97 |
| B | SMAW | 110.3 | 52.1 | 49 | 45.5 | 91 |
| C | SMAW | 117.7 | 52.3 | 21 | 20.6 | 94/95 |
| D | SMAW | 96.2 | 47.0 | 13 | 12.2 | 91/93 |

*A = As Welded
*B = Welded + Annealed 2200° F./1 h, WQ
*C = Welded + Annealed 2200° F./1 h, WQ + Exposed 1550° F./1000 h, AC
*D = Welded + Annealed 2200° F./1 h, WQ + Exposed 1832° F./1000 h, AC The subject alloy can be melted in conventional melting equipment such as air or vacuum induction furnaces or electroslag remelt furnaces. Vacuum processing is preferred. The alloy is useful for application in which its predecessor has been used, including gas turbine components such as combustion liners.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A nickel-chromium-molybdenum base alloy characterized at temperatures of 1800° F. and higher by (i) a high level of structural stability as determined by its ability to absorb energy over prolonged periods of time of at least 3000 hours at such temperatures, (ii) good ductility together with satisfactory (iii) tensile strength and (iv) stress-rupture strength as well as (v) resistance to oxidation, including cyclic oxidation, said alloy consisting of about 20 to 30% chromium, silicon up to 0.15%, about 0.05 to 0.1% carbon, about 7.5 to 8.75% molybdenum, about 7.5 to 20% cobalt, up to about 0.6% titanium, about 0.8 to 1.5% aluminum, up to about 0.006% boron, up to about 0.1% zirconium and the balance essentially nickel, said alloy being further characterized by an average grain size of about ASTM 1.5 to about ASTM 5.

2. The alloy of claim 1 in the final annealed condition, the annealing temperature being above about 2025° F. and up to 2125° F.

3. The alloy of claim 2 in which the silicon content is less than 0.1%, the carbon is from 0.05% to 0.07%, and the molybdenum is at least about 8%.

4. The alloy of claim 3 in which the average size of the grain is from ASTM 1.5 to 4.5.

5. The alloy of claim 1 characterized by a Charpy-V-Notch impact strength of at least 50 ft. lbs. when exposed at 1832° F. for a period of 10,000 hours.

6. A nickel-chromium-molybdenum base alloy characterized at temperatures of 1800° F. and higher by (i) a high level of structural stability as determined by its ability to absorb energy over prolonged periods of time of at least 3000 hours at such temperatures, (ii) good ductility together with satisfactory (iii) tensile strength and (iv) stress-rupture strength as well as (v) resistance to oxidation, including cyclic oxidation, said alloy consisting of about 19 to 30% chromium, less than 0.25% silicon, 0.05 to 0.15% carbon, 7.5 to less than 9% molybdenum, about 7.5 to 20% cobalt, up to 0.6% titanium, about 0.8 to 1.5% aluminum, up to 0.006% boron, up to 0.1% zirconium, up to 5% iron, up to 5% tungsten and the balance being essentially nickel, said alloy being further characterized by an average grain size from ASTM 00 to about 5.5 about ASTM 5.

7. The alloy of claim 6 in which the percentages of silicon and molybdenum are correlated as follows:

| % Silicon | % Molybdenum |
|---|---|
| 0.01–0.1 | less than 9 |
| 0.1–0.15 | less than 8.75 |
| 0.15–0.25 | less than 8.5 |

8. The alloy of claim 7 in the final annealed condition, the annealing temperature being above about 2000° F. and less than about 2150° F. and the average grain size being from about ASTM 1 to about 5.

9. The alloy of claim 8 in which the chromium is from 19 to 23%, the silicon content is less than 0.1%, the carbon is from 0.05%, to 0.07%, the molybdenum is from 8 to 8.75%, and iron, if any, is not greater than 2%.

10. The alloy of claim 8 having been given a final annealing treatment at 2025° to 2125° F.

11. The alloy of claim 8 in which the average size of the grain is from ASTM 1.5 to 4.5.

12. The alloy of claim 6 characterized by a Charpy-V-Notch impact strength of at least 30 ft. lbs. when exposed at 1832° F. for a period of 10,000 hours.

13. The alloy of claim 8 characterized by a Charpy-V-Notch impact strength of at least 50 ft. lbs. when exposed at 1832° F. for a period of 10,000 hours.

* * * * *